US010085496B2

(12) United States Patent
Ledingham

(10) Patent No.: US 10,085,496 B2
(45) Date of Patent: Oct. 2, 2018

(54) COMPARTMENTALIZED HAND WARMER

(71) Applicant: John Ledingham, Carr, CO (US)

(72) Inventor: John Ledingham, Carr, CO (US)

( * ) Notice: Subject to any disclaimer, the term of this patent is extended or adjusted under 35 U.S.C. 154(b) by 34 days.

(21) Appl. No.: 15/457,863

(22) Filed: Mar. 13, 2017

(65) Prior Publication Data

US 2017/0265535 A1 Sep. 21, 2017

Related U.S. Application Data

(63) Continuation of application No. 29/558,593, filed on Mar. 18, 2016, now Pat. No. Des. 783,227.

(51) Int. Cl.

| | |
|---|---|
| ***A41D 13/00*** | (2006.01) |
| ***A41D 13/005*** | (2006.01) |
| ***A41D 13/08*** | (2006.01) |

(52) U.S. Cl.

CPC ..... *A41D 13/0058* (2013.01); *A41D 13/0051* (2013.01); *A41D 13/081* (2013.01)

(58) Field of Classification Search

CPC ..... A41D 13/0058; A41D 13/0051; A41D 13/081; A41D 19/002

See application file for complete search history.

(56) References Cited

U.S. PATENT DOCUMENTS

| | | | | |
|---|---|---|---|---|
| 251,837 | A | 1/1882 | Coombs | |
| 4,504,980 | A * | 3/1985 | Butcher | A41D 13/081 2/160 |
| 4,535,482 | A | 8/1985 | Spector et al. | |
| 4,805,242 | A * | 2/1989 | Bolton | A41D 19/002 2/160 |
| 5,269,023 | A | 12/1993 | Ross | |
| 5,496,358 | A | 3/1996 | Rosenwald | |
| 5,496,359 | A | 3/1996 | Davidson | |
| D410,956 | S * | 6/1999 | Adams Zurawin | D29/113 |
| 6,141,801 | A | 11/2000 | Helenick | |
| 7,251,837 | B1 | 8/2007 | Horton | |
| 7,334,711 | B1 * | 2/2008 | Winters | A45F 5/00 224/217 |
| D595,928 | S | 7/2009 | Swanson | |
| 8,776,268 | B2 | 7/2014 | Rodgers et al. | |
| D743,141 | S | 11/2015 | Kafka et al. | |
| D763,568 | S * | 8/2016 | Singhal | D3/218 |
| D783,227 | S * | 4/2017 | Ledingham | A41D 13/0051 D2/610 |
| 9,700,087 | B2 * | 7/2017 | Tiffin | A41D 19/0157 |
| 2003/0093017 | A1 * | 5/2003 | Loud | A61F 5/0118 602/2 |
| 2004/0172736 | A1 | 9/2004 | Reid | |
| 2004/0244090 | A1 | 12/2004 | Langer | |

(Continued)

OTHER PUBLICATIONS

Design U.S. Appl. No. 29/558,593, filed Mar. 18, 2016.

*Primary Examiner* — Shaun R Hurley
*Assistant Examiner* — Andrew W Sutton
(74) *Attorney, Agent, or Firm* — Craig R. Miles; CR MILES P.C.

(57) ABSTRACT

A compartmentalized hand warmer including one or more of a first flexible panel joined in face contacting relation to a second flexible panel and configured to have a compartment adapted to receive a warming element, a first annular element coupled to the first flexible panel, and a second annular element coupled to the first flexible panel in opposed relation to the first annular element.

20 Claims, 10 Drawing Sheets

(56) References Cited

U.S. PATENT DOCUMENTS

| | | | | |
|---|---|---|---|---|
| 2006/0021105 | A1* | 2/2006 | Wilson | A41D 13/081 2/20 |
| 2010/0078452 | A1* | 4/2010 | Grise | A41D 13/0051 224/237 |
| 2011/0007552 | A1 | 1/2011 | Ahn et al. | |
| 2011/0072552 | A1* | 3/2011 | Johnson | A41D 19/002 2/160 |
| 2011/0088134 | A1 | 4/2011 | Farrer | |
| 2011/0088138 | A1* | 4/2011 | Chen | A41D 19/01535 2/160 |
| 2014/0230127 | A1 | 8/2014 | Cruz | |
| 2017/0258689 | A1* | 9/2017 | Drysdale | A61J 17/02 |
| 2017/0265535 | A1* | 9/2017 | Ledingham | A41D 13/0051 |
| 2017/0360149 | A1* | 12/2017 | Dodd | A43B 7/32 |

* cited by examiner

COMPARTMENTALIZED HAND WARMER

This U.S. Non-Provisional patent application is a continuation of U.S. Design patent application Ser. No. 29/558,593, filed Mar. 18, 2016, hereby incorporated by reference herein.

I. FIELD OF THE INVENTION

A compartmentalized hand warmer including one or more of a first flexible panel joined in face contacting relation to a second flexible panel configured to have a compartment adapted to receive a warming element, a first annular element coupled to the first flexible panel proximate a panel first side, and a second annular element coupled coupled to the first flexible panel in opposed relation to the first annular element proximate a first flexible panel proximate a panel second side.

II. BACKGROUND OF THE INVENTION

The extremities of the human body, including the hands and feet, can be more susceptible to the effects of cold weather, losing heat more rapidly than the body core and occasionally suffering from frostbite or other similar ailments. To prevent symptoms related to cold temperatures from afflicting the extremities of the human body, warming elements have been developed for application to the extremities of the human body during activities in cold temperatures.

III. SUMMARY OF THE INVENTION

Accordingly a broad object of the invention can be to provide a compartmentalized hand warmer including one or more of: a first flexible panel joined to a second flexible panel in face contacting relation to define a compartment having at least one opening to access an interior space adapted to receive a warming element, a first annular element coupled to a first flexible panel defining a first aperture disposable about a wrist of a hand, and a second annular element coupled to a first flexible panel in opposite relation to a first annular element defining a second aperture disposable about a finger of a hand.

Another broad object of the invention can be to provide a method of making a compartmentalized hand warmer including one or more of: joining a first flexible panel to a second flexible panel in face contacting relation to define a compartment having at least one opening to access an interior space adapted to receive a warming element, coupling a first annular element to a first flexible panel defining a first aperture disposable about a wrist of a hand, and coupling a second annular element to a first flexible panel in opposite relation to a first annular element defining a second aperture disposable about a finger of a hand.

Another broad object of the invention can be to provide a method of using a compartmentalized hand warmer including one or more of: obtaining a compartmentalized hand warmer including one or more of a first flexible panel joined to a second flexible panel in face contacting relation to define a compartment having at least one opening to access an interior space adapted to receive a warming element, a first annular element coupled to a first flexible panel defining a first aperture disposable about a wrist of a hand, and a second annular element coupled to a first flexible panel in opposite relation to a first annular element defining a second aperture disposable about a finger of a hand; disposing a first annular element about a wrist of a hand, disposing a second annular element about a first finger of a hand; obtaining a warming element; and insertingly engaging a warming element in the interior space of the compartment.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
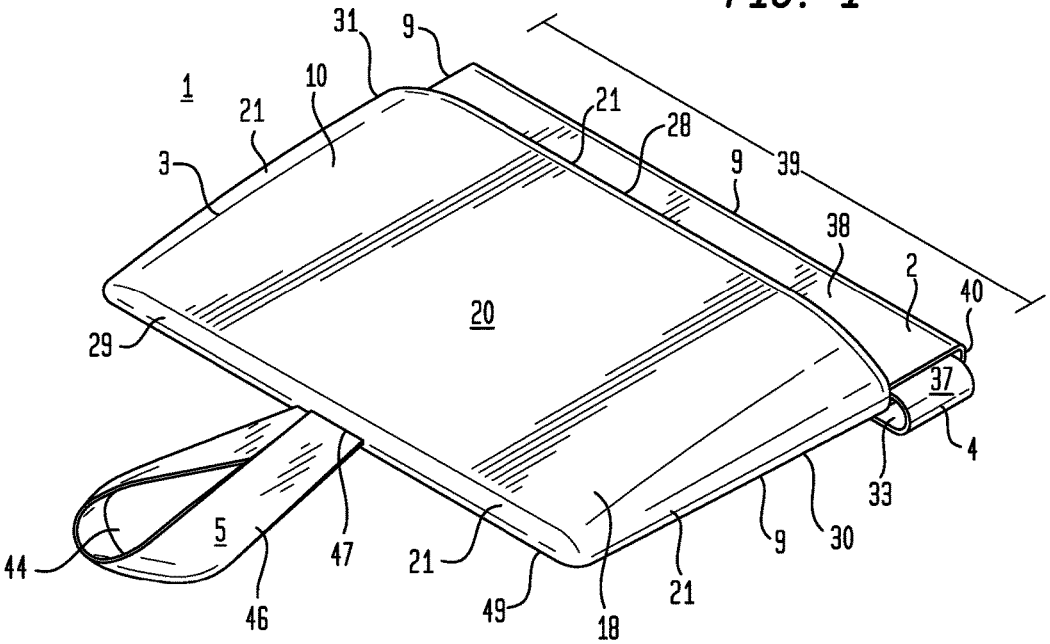
FIG. 1 is a top perspective view of a particular embodiment of a compartmentalized hand warmer.
Figure 2:
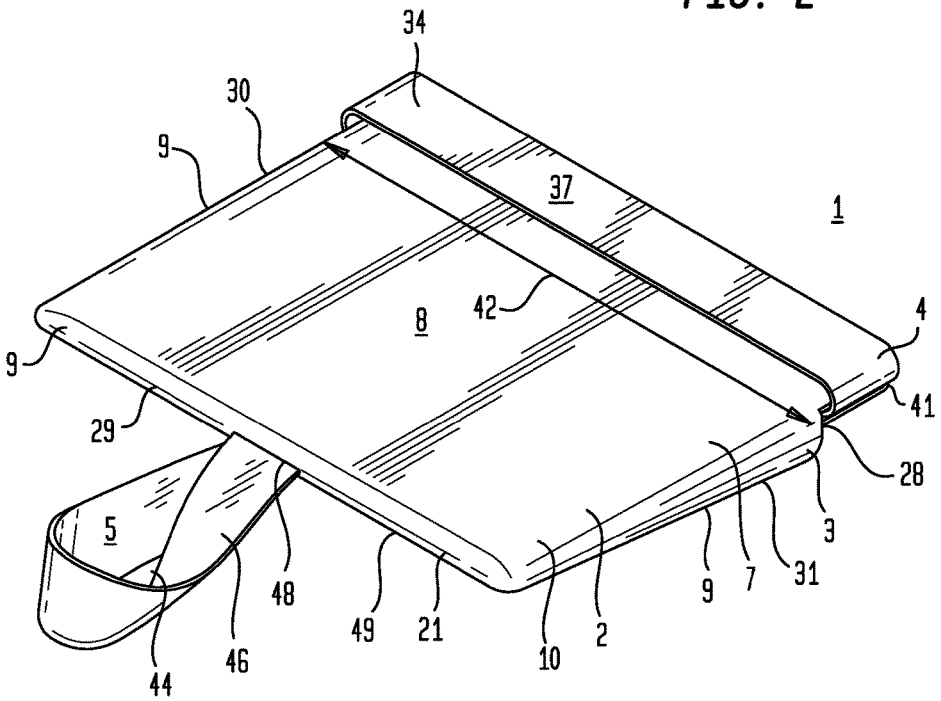
FIG. 2 is a bottom perspective view of a particular embodiment of a compartmentalized hand warmer.
Figure 3:
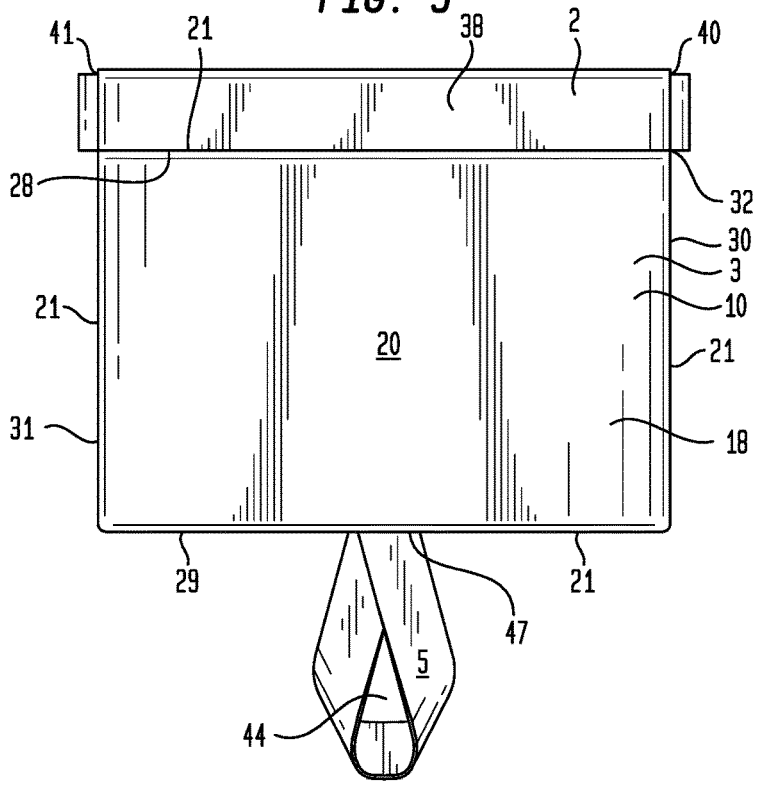
FIG. 3 is a top plan view of a particular embodiment of a compartmentalized hand warmer.
Figure 4:
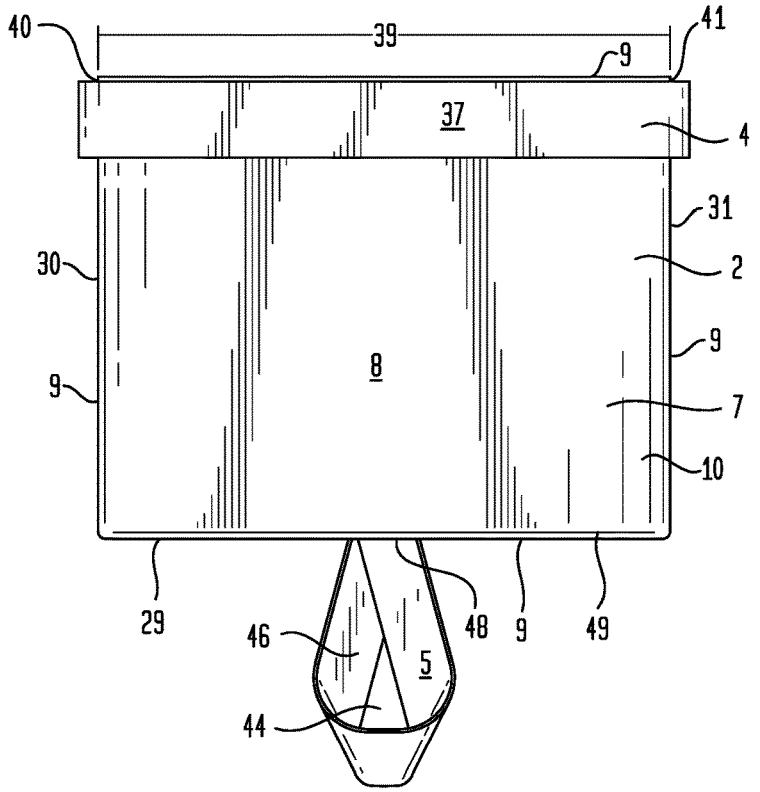
FIG. 4 is a bottom plan view of a particular embodiment of a compartmentalized hand warmer.
Figure 5:
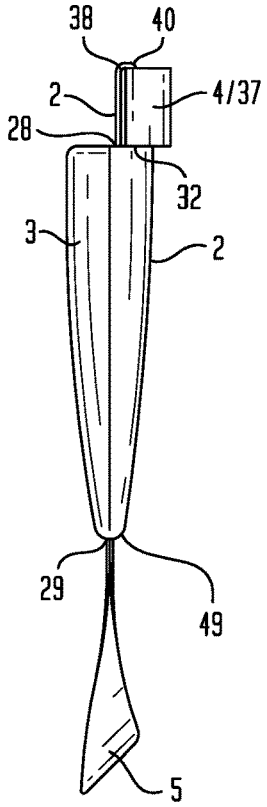
FIG. 5 is a first side elevation view of a particular embodiment of a compartmentalized hand warmer.
Figure 6:
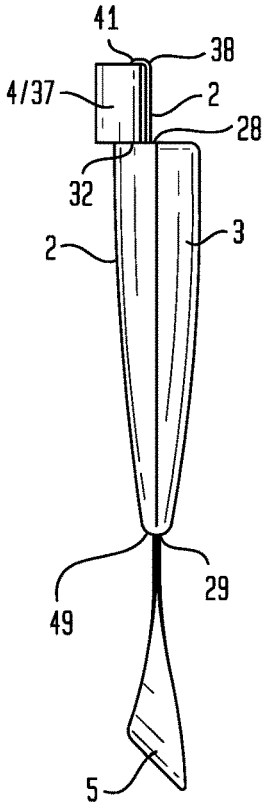
FIG. 6 is a second side elevation view of a particular embodiment of a compartmentalized hand warmer.

Generally referring to FIGS. 1 through 9, particular embodiments of a compartmentalized hand warmer (1) can include a first flexible panel (2), a second flexible panel (3), a first annular element (4), and a second annular element (5). The first flexible panel (2) can include a first flexible panel top face (6) opposite a first flexible panel bottom face (7)

having a first flexible panel area (8) extending to a first flexible panel peripheral margin (9). While the configuration of the first flexible panel (2) shown in the Figures generally defines a quadrilateral (10) configuration; this is not intended to preclude embodiments of the first flexible panel (2) having a first flexible panel peripheral margin (9) which generally defines a circle, an oval, or other polygonal or geometric configurations. In further particular embodiments, the first flexible panel area (8) can partially extend or wholly extend across a palm side (11) or a dorsal side (12) of the hand (13), between a medial side (14) and a lateral side (15) of the hand (13), and between a wrist (16) and a base of fingers (17).

Figure 7:
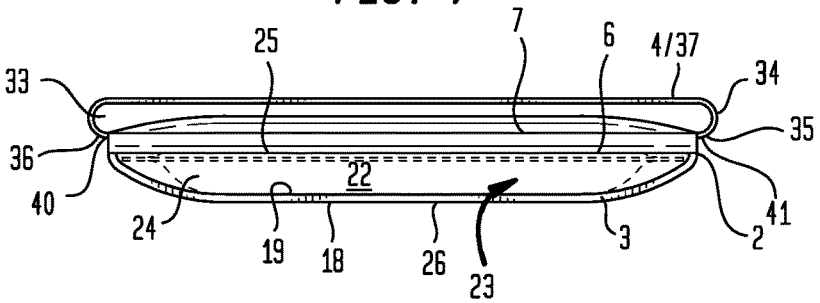
FIG. 7 is a rear elevation view of a particular embodiment of a compartmentalized hand warmer.
Figure 8:
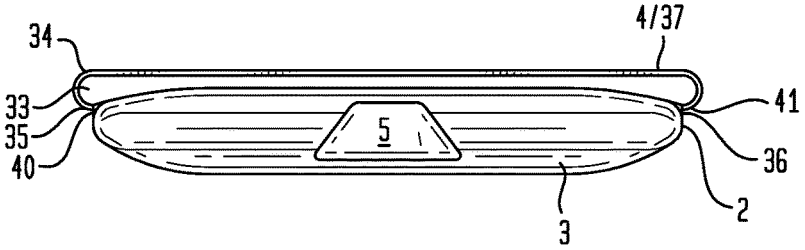
FIG. 8 is a front elevation view of a particular embodiment of a compartmentalized hand warmer.

Particular embodiments of a compartmentalized hand warmer (1) can further include a second flexible panel (3). The second flexible panel (3) can include a second flexible panel top face (18) and a second flexible panel bottom face (19) having a second flexible panel area (20) extending to a second flexible panel peripheral margin (21). The second flexible panel (3) can, but need not necessarily, be generally configured to the geometric configuration of the first flexible panel (2) and generally have an equal or lesser second flexible panel area (20) compared to the first flexible panel (2). A second flexible panel bottom face (19) can be disposed in contacting relation with a first flexible panel top face (6). The first flexible panel peripheral margin (9) and the second flexible panel peripheral margin (21) can be coupled to define a compartment (22) having an interior space (23). As to particular embodiments, the first flexible panel peripheral margin (9) and the second flexible panel peripheral margin (21) can be coupled with at least a portion of the first and second flexible panel peripheral margins (9)(21) remaining uncoupled to define a compartment opening (24) to access the interior space (23) inside the compartment (22). In the example shown in the Figures, the first and second flexible panel peripheral margins (9)(21) of at least one of the panel sides (25) of the first flexible panel (2) and a corresponding at least one of the panel sides (26) of the second flexible panel (3) are not coupled to define a compartment opening (24) to access the interior space (23) of the compartment (22). By way of illustration, FIGS. 1 and 7 show a first flexible panel (2) configured as a quadrilateral (10) and a second flexible panel (3) configured as a quadrilateral (10) which have generally equal first and second flexible panel areas (8)(20). The first and second flexible panel peripheral margins (9)(21) can be coupled along three of the four panel sides (25) of the first flexible panel (2) and corresponding panel sides (26) of the second flexible panel (3), leaving the remaining panel side (27) uncoupled to define a compartment opening (24) to access the interior space (23) defined by the compartment (22).

In the illustrative example of FIGS. 1 and 7, the compartment opening (24) occurs at the compartment bottom (28), however, this is not intended to preclude embodiments which have the compartment opening (24) occur at the compartment top (29), a compartment first side (30), or a compartment second side (31). In further particular embodiments, the first and second flexible panel peripheral margins (9)(21) of more than one of the panel sides (25) of the first flexible panel (2) and the corresponding panel sides (26) of the second flexible panel (3) can be uncoupled to define a compartment opening (24) to access the interior space (23) of the compartment (22). The compartment opening (24) can occur at two or more of the compartment top (29), compartment bottom (28), compartment first side (30), or compartment second side (31), or other compartment side, depending on the configuration of the compartment (22).

Particular embodiments of a compartmentalized hand warmer (1) can further include a first annular element (4) disposed proximate the bottom side (32) of the first flexible panel (2) defining a first aperture (33). The first aperture (33) can be configured to allow a hand (13) to pass through the first aperture (33) so that the first annular element (4) can be disposed around a wrist (16) of the hand (13). As to particular embodiments, the first annular element (4) can, but need not necessarily, comprise a length of material (34) disposed between a first end (35) and a second end (36), each first and second end (35)(36) coupled to the first flexible panel (2) proximate the first flexible panel bottom side (32). In other particular embodiments, as shown in the examples of FIGS. 1, 2, 5, and 6, the first annular element (4) can be a loop of material (37) having a portion passing through a conduit (38) disposed in the first flexible panel (2) proximate the first flexible panel bottom side (32). The conduit (38) can have a length (39) disposed between a conduit first end (40) and a conduit second end (41). The length (39) of the conduit (38) can, but need not necessarily, be generally equal to the length (42) of the first flexible panel bottom side (32). The first annular element (4) can be disposed in the conduit (38) by passing a length (43) of the first annular element (4) through the length (39) of the conduit (38).

In particular embodiments of a compartmentalized hand warmer (1), a second annular element (5) defining a second aperture (44) can be coupled to the first flexible panel (2) in opposed relation to the first annular element (4). The second aperture (44) can be configured to allow a first finger (45) of a hand (13) to pass through the second aperture (44) and dispose the second annular element (5) around a first finger (45). In particular embodiments, the second annular element (5) can be a length of material (46) disposed between a first end (47) and a second end (48). The first end (47) and second end (48) can be coupled in adjacent or overlapping relation proximate the first flexible panel top side (49), and the second annular element (5) can extend outward from the first flexible panel top side (49). In particular embodiments, the second annular element (5) can, but need not necessarily, be medially located on the first flexible panel top side (49), as illustrated in the example of FIG. 1.

Now referring generally to FIGS. 10 through 18, particular embodiments of a compartmentalized hand warmer (1) can further include a third annular element (50), which can define a third aperture (51) and be coupled to the first flexible panel (2) in opposed relation to the first annular element (4) and adjacent the second annular element (5). The third aperture (51) can be configured to allow a second finger (52) of a hand (13) to pass through the third aperture (51) and further dispose the third annular element (50) around the second finger (52). In particular embodiments, the third annular element (50) can be a length of material (53) disposed between a first end (54) and a second end (55). The first end (54) and second end (55) can be coupled in adjacent or overlapping relation proximate the first flexible panel top side (49), and the third annular element (50) can extend outward from the first flexible panel top side (49). In particular embodiments, the second annular element (5) and third annular element (50) can, but need not necessarily, be coupled to the first flexible panel top side (49), one of each being disposed proximate the opposing panel sides (25) of the first flexible panel top side (49).

In particular embodiments, the material comprising the first flexible panel (2) and the second flexible panel (3) can be selected from the group including or consisting of leather, polyester, LYCRA, nylon, spandex, rayon, cotton, wool, linen, vinyl, or combinations thereof. The length of material comprising the first annular element (4), second annular element (5), and third annular element can be selected from the group including or consisting of polyester, LYCRA, nylon, spandex, rayon, cotton, wool, linen, vinyl, or combinations thereof.

Figure 19:
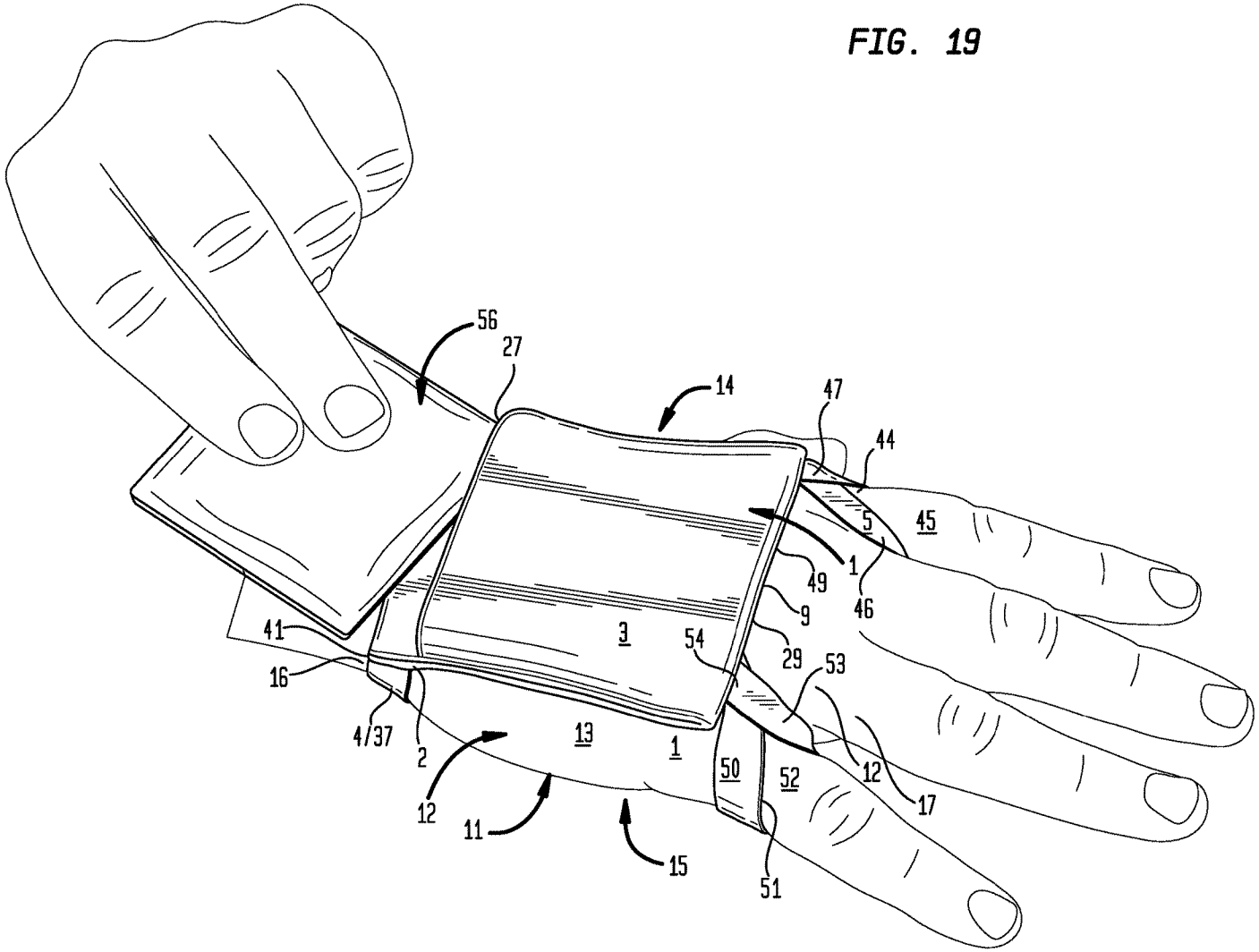
FIG. 19 is a top perspective view of a particular embodiment of a compartmentalized hand warmer disposed on the hand of a wearer and receiving in a compartment a warming element.
Figure 20:
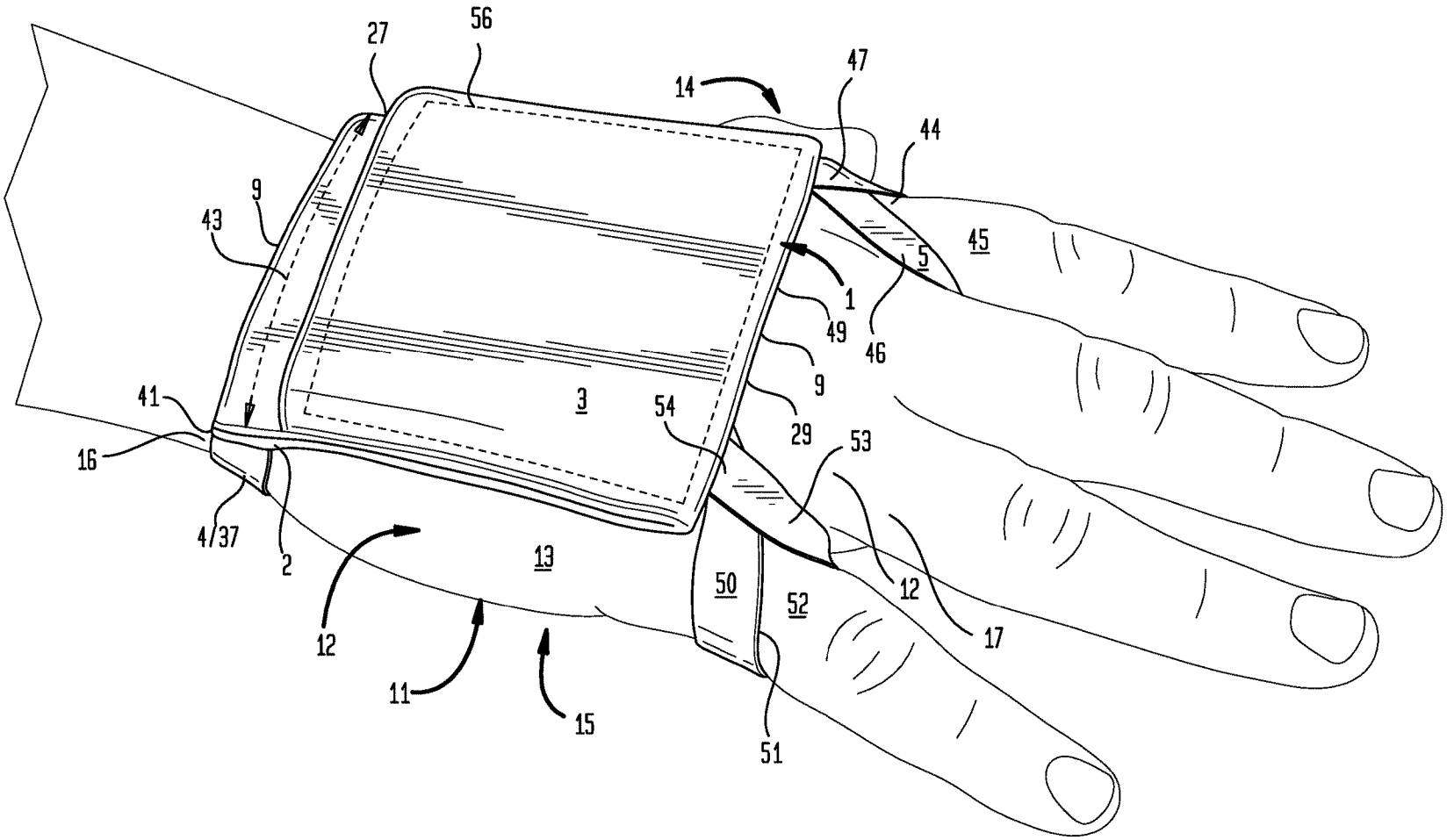
FIG. 20 is a top perspective view of a particular embodiment of a compartmentalized hand warmer disposed on the hand of a wearer including a warming element received in a compartment.

Now referring to FIGS. 19 and 20, particular embodiments of a compartmentalized hand warmer (1) can include a warming element (56). The warming element (56) can be one or more of an exothermic mixture of materials contained in an enclosed chamber, a heated material or other material capable of storing heat, a heated fluid contained in an enclosed chamber, or other like configuration capable of dissipating heat.

Figure 9:
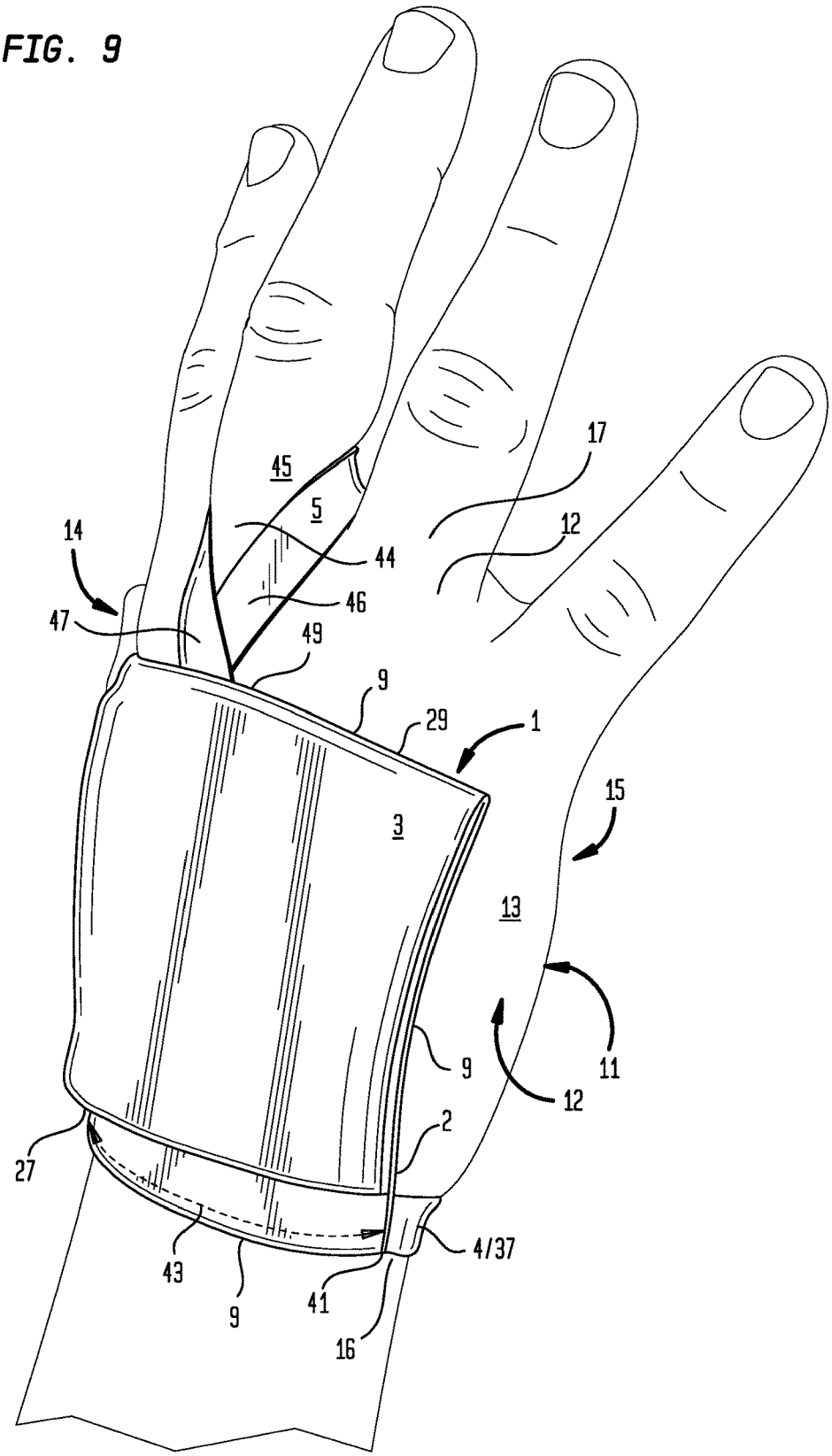
FIG. 9 is a top perspective view of a particular embodiment of a compartmentalized hand warmer disposed on the hand of a wearer.
Figure 10:
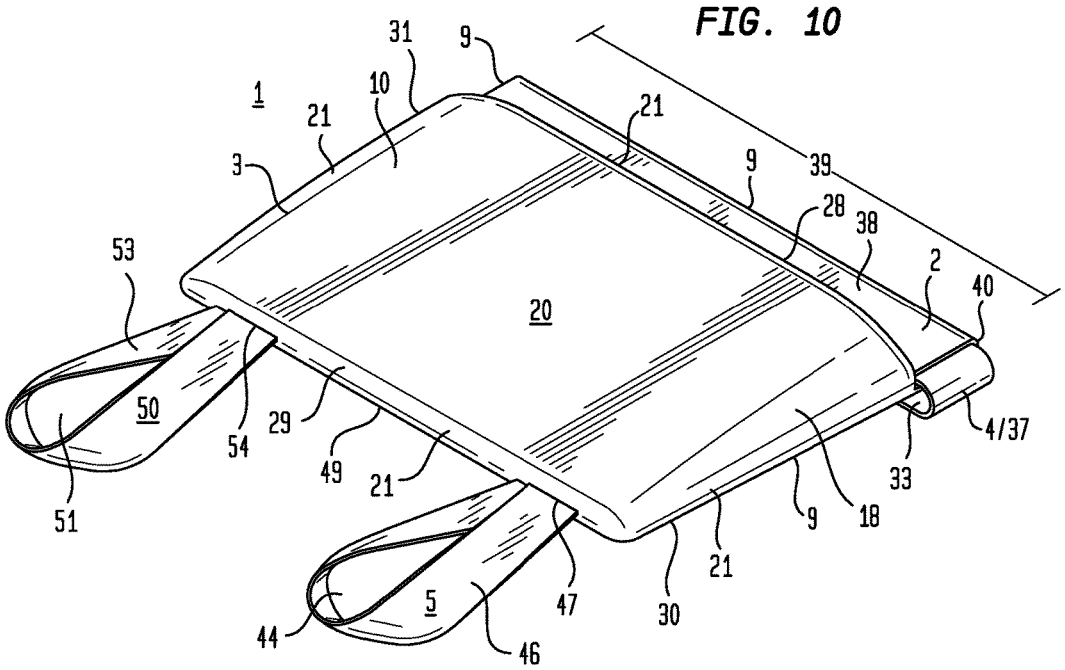
FIG. 10 is a top perspective view of a particular embodiment of a compartmentalized hand warmer.
Figure 11:
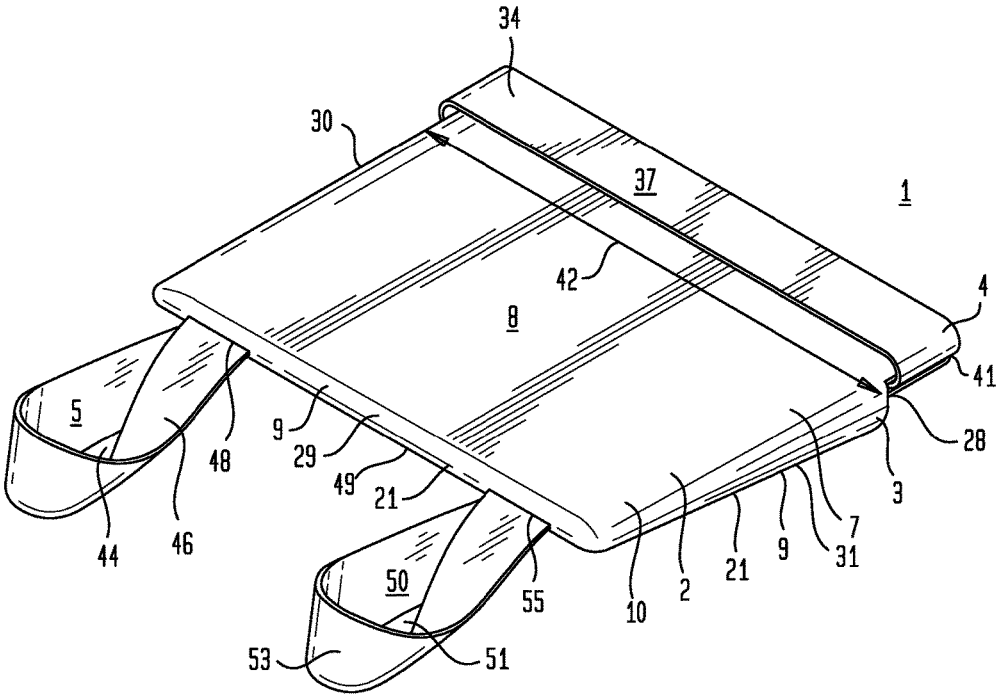
FIG. 11 is a bottom perspective view of a particular embodiment of the compartmentalized hand warmer.
Figure 12:
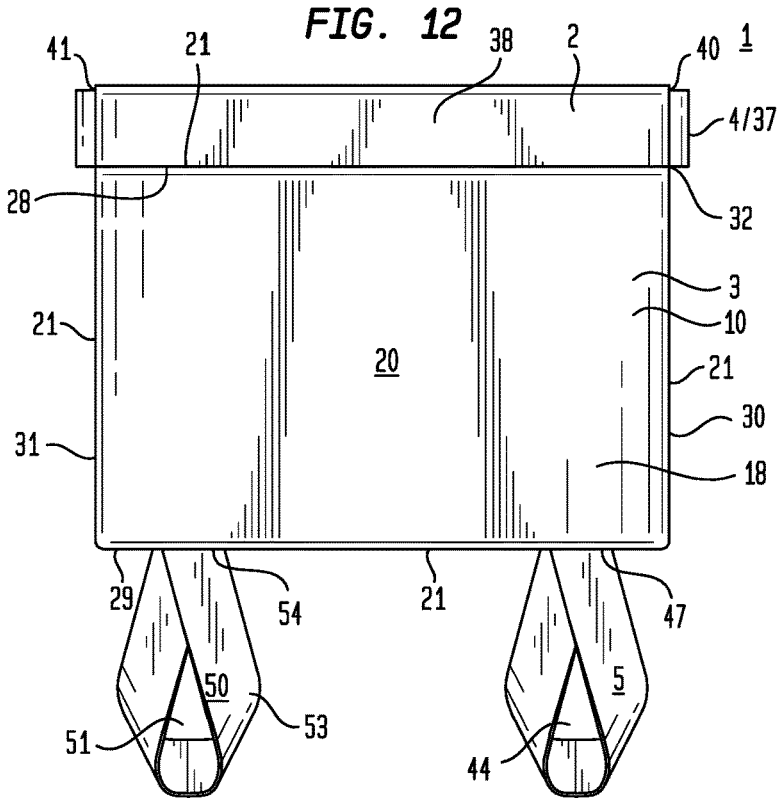
FIG. 12 is a top plan view of a particular embodiment of a compartmentalized hand warmer.
Figure 13:
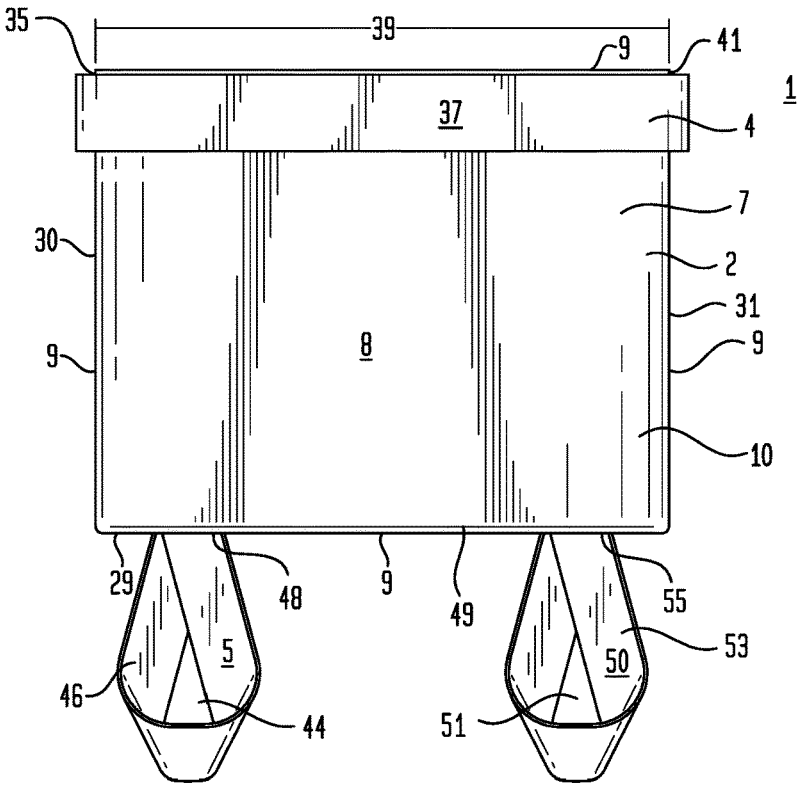
FIG. 13 is a bottom plan view of a particular embodiment of a compartmentalized hand warmer.
Figure 14:
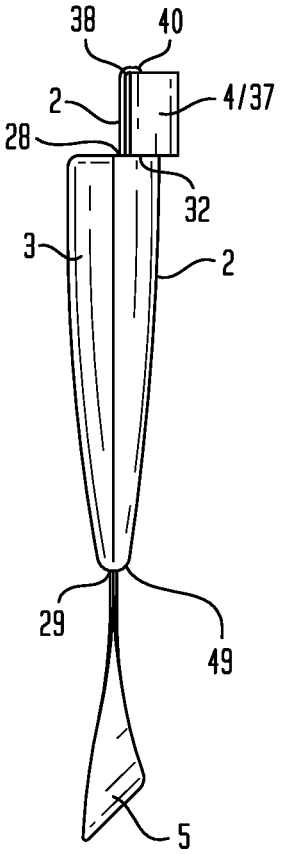
FIG. 14 is a first side elevation view of another particular embodiment of a compartmentalized hand warmer.
Figure 15:
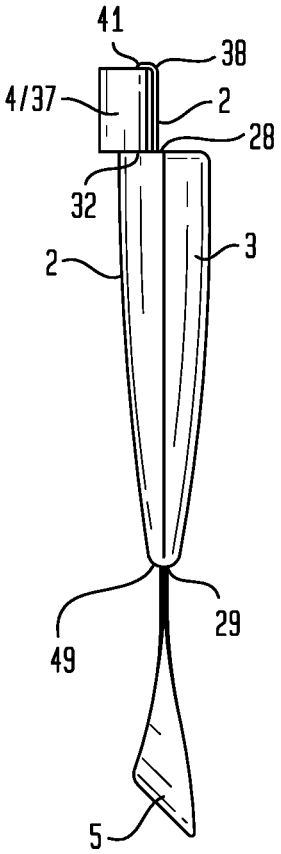
FIG. 15 is a second side elevation view of another particular embodiment of a compartmentalized hand warmer.
Figure 16:
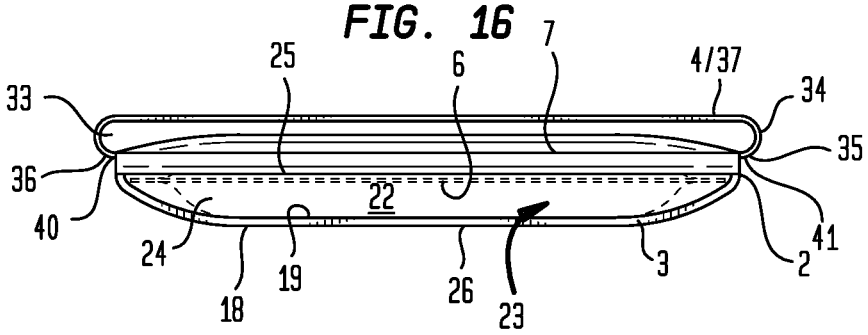
FIG. 16 is a rear elevation view of another particular embodiment of a compartmentalized hand warmer.
Figure 17:
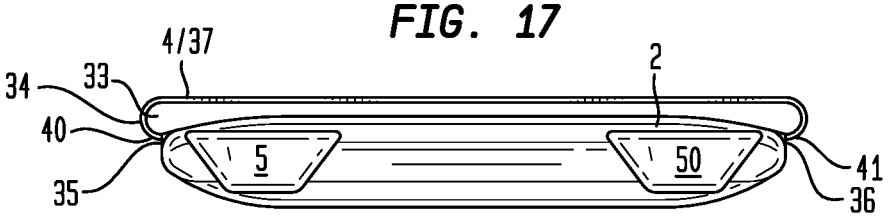
FIG. 17 is a front elevation view of a particular embodiment of a compartmentalized hand warmer.
Figure 18:
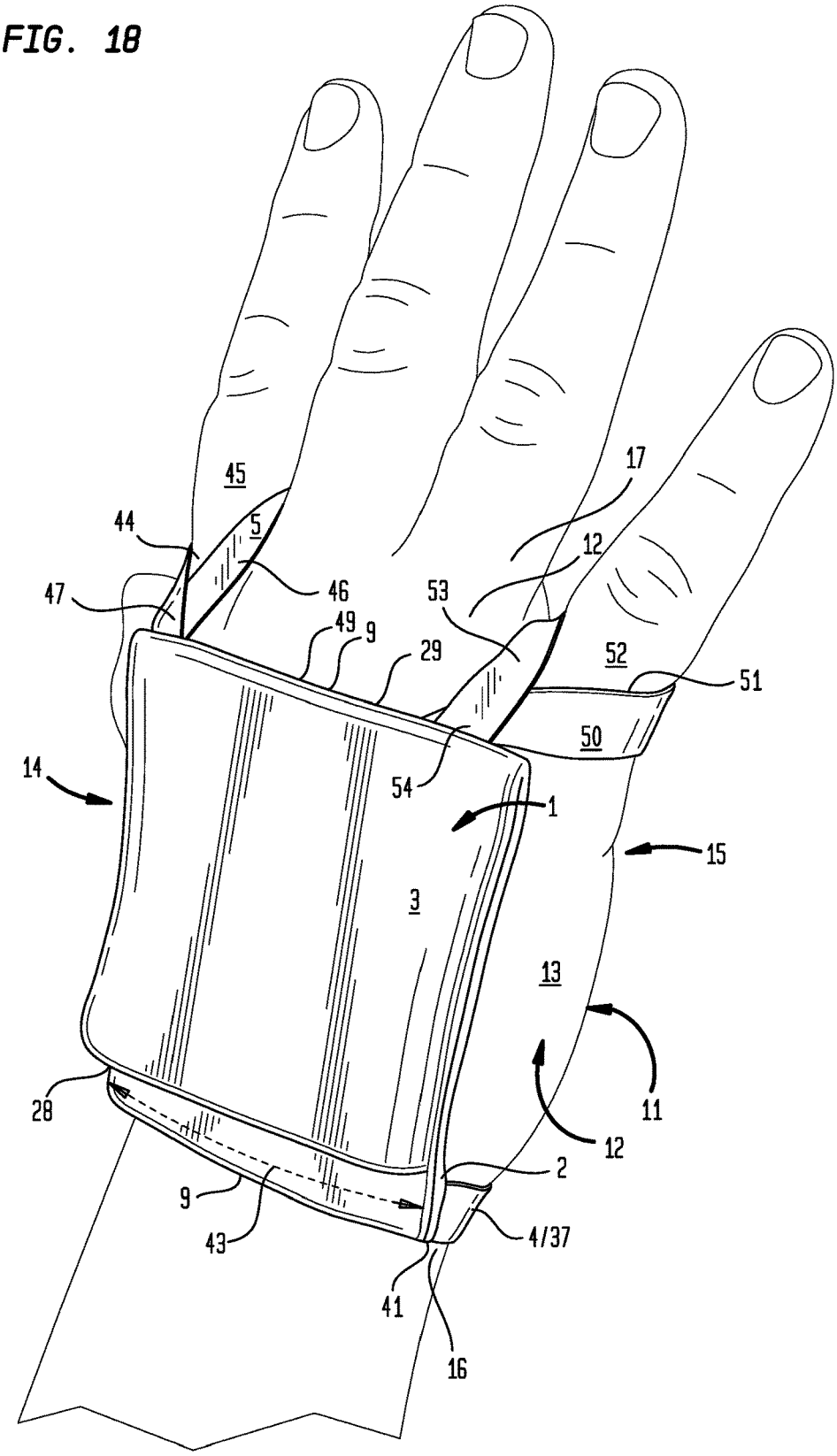
FIG. 18 is a top perspective view of a particular embodiment of a compartmentalized hand warmer disposed on the hand of a wearer.

Now referring to FIGS. 9 and 18, a particular method of using a compartmentalized hand warmer (1) can include one or more of obtaining a compartmentalized hand warmer (1) including a first flexible panel (2), a second flexible panel (3), a first annular element (4), and at least a second annular element (5) (or a first, second, and third annular element (4)(5)(50)), obtaining a warming element (56), disposing the first annular element (4) around the wrist (16) of a hand (13), disposing the second annular element (5) around a first finger (45) of the hand (13), and insertingly engaging the warming element (56) in the interior space (23) of the compartment (22); the first flexible panel (2), second flexible panel (3), first annular element (4), and second annular element (5) being described above. In further particular embodiments, a third annular element (50) can be disposed around a second finger (52) of the hand (13), the third annular element (50) being described above.

As can be easily understood from the foregoing, the basic concepts of the present invention may be embodied in a variety of ways. The invention involves numerous and varied embodiments of a compartmentalized hand warmer and methods for making and using compartmentalized hand warmers including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "flexible first panel" should be understood to encompass disclosure of the act of "flexing"—whether explicitly discussed or not—and, conversely, were there effectively disclosure of the act of "flexing", such a disclosure should be understood to encompass disclosure of a "flexible first panel" and even a "means for flexing." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the compartmentalized hand warmers herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A compartmentalized hand warmer, comprising:

a first flexible panel extending to a peripheral margin defining a first flexible panel area configured to at least partially extend across a side of a hand between a medial side and a lateral side and between a wrist and a base of fingers;

a second flexible panel joined in face contacting relation to said first flexible panel to define a compartment having at least one opening to access an interior space adapted to receive a warming element;

a first annular element coupled to said first flexible panel, said first annular element defining a first aperture, configured to allow said hand to pass through said first aperture to locate said first annular element about said wrist of said hand; and a second annular element coupled to said first flexible panel in opposed relation to said first annular element, said second annular element defining a second aperture configured to allow a first finger of said hand to pass through said second aperture to locate said second annular element about said first finger of said hand, said first annular element disposable about said wrist and said second annular element disposable about said first finger to secure said compartment adjacent said side of said hand.

2. The compartmentalized hand warmer of claim 1, further comprising a third annular element coupled to said first flexible panel, adjacent said second annular element, said third annular element defining a third aperture configured to allow a second finger of said hand to pass through said third aperture to locate said third annular element about said second finger of said hand, said first annular element disposable about said wrist and said second annular element and said third annular element disposable about said first finger and said second finger respectively to secure said compartment adjacent said side of said hand.

3. The compartmentalized hand warmer of claim 1, wherein said first annular element medially coupled to and extending outward of a first flexible panel bottom.

4. The compartmentalized hand warmer of claim 2, wherein said second annular element and said third annular element coupled to and extending outward of said first flexible panel top proximate opposite first flexible panel first and second sides.

5. The compartmentalized hand warmer of claim 4, further comprising a conduit having a length disposed between a conduit first end and a conduit second end disposed on said first flexible panel opposite said second annular element defining a conduit passage, wherein said first annular element disposed in said conduit between said conduit first end and said conduit second end.

6. The compartmentalized hand warmer of claim 5, wherein said compartment opening occurs at any one or more of a compartment top, a compartment bottom, a compartment first side, and a compartment second side.

7. The compartmentalized hand warmer of claim 6, wherein said compartment opening occurs at two of said compartment top, said compartment bottom, said compartment first side, and said compartment second side.

8. The compartmentalized hand warmer of claim 7, wherein said second annular element comprises a length of material disposed between a first end and a second end, said first end and said second end proximately coupled to said first flexible panel top.

9. The compartmentalized hand warmer of claim 8, wherein said third annular element comprises a length of material disposed between a first end and a second end, said first end and said second end proximately coupled to said flexible panel top.

10. The compartmentalized hand warmer of claim 9, wherein said first annular element configured as a loop of material.

11. The compartmentalized hand warmer of claim 10, further comprising a warming element receivable in said interior space of said compartment.

12. A compartmentalized hand warmer, comprising:

a first flexible panel extending to a peripheral margin defining a first flexible panel area configured to at least partially extend across a side of a hand between a medial side and a lateral side and between a wrist and a base of fingers;

a second flexible panel joined in face contacting relation to said first flexible panel to define a compartment having at least one opening to access an interior space adapted to receive a warming element;

a first annular element coupled to said first flexible panel, said first annular element defining a first aperture, configured to allow said hand to pass through said first aperture to locate said first annular element about said wrist of said hand;

a second annular element coupled to said first flexible panel in opposed relation to said first annular element, said second annular element defining a second aperture configured to allow a first finger of said hand to pass through said second aperture to locate said second annular element about said first finger of said hand, said first annular element disposable about said wrist and said second annular element disposable about said first finger to secure said compartment adjacent said side of said hand; and a warming element receivable in said interior space of said compartment.

13. The compartmentalized hand warmer of claim 12, further comprising a third annular element coupled to said first flexible panel, adjacent said second annular element, said third annular element defining a third aperture configured to allow a second finger of said hand to pass through said third aperture to locate said third annular element about said second finger of said hand, said first annular element disposable about said wrist and said second annular element and said third annular element disposable about said first finger and said second finger respectively to secure said compartment adjacent said side of said hand.

14. The compartmentalized hand warmer of claim 12, wherein said first annular element medially coupled to and extending outward of a first flexible panel bottom.

15. The compartmentalized hand warmer of claim 13, wherein said second annular element and said third annular element coupled to and extending outward of said first flexible panel top proximate opposite first flexible panel first and second sides.

16. The compartmentalized hand warmer of claim 15, further comprising a conduit having a length disposed between a conduit first end and a conduit second end disposed on said first flexible panel opposite said second annular element defining a conduit passage, wherein said first annular element disposed in said conduit between said conduit first end and said conduit second end.

17. The compartmentalized hand warmer of claim 16, wherein said compartment opening occurs at any one or more of a compartment top, a compartment bottom, a compartment first side, and a compartment second side.

18. The compartmentalized hand warmer of claim 17, wherein said second annular element comprises a length of material disposed between a first end and a second end, said first end and said second end proximately coupled to said first flexible panel top.

19. The compartmentalized hand warmer of claim 18, wherein said third annular element comprises a length of material disposed between a first end and a second end, said first end and said second end proximately coupled to said flexible panel top.

20. The compartmentalized hand warmer of claim 19, wherein said first annular element configured as a loop of material.

* * * * *